US005902064A

United States Patent [19]

Yamanaka

[11] Patent Number: 5,902,064

[45] Date of Patent: May 11, 1999

[54] CONICAL PENPOINT METHOD OF MANUFACTURE

[76] Inventor: Shizuo Yamanaka, 15-33-706, Shimo-renjaku 4-chrome, Mitaka, Japan

[21] Appl. No.: 08/888,633

[22] Filed: Jul. 7, 1997

Related U.S. Application Data

[63] Continuation of application No. 08/358,399, Dec. 19, 1994, abandoned.

[30] Foreign Application Priority Data

Feb. 26, 1994 [JP] Japan ..... 6-052695

[51] Int. Cl.[6] ..... B43K 1/00; B43K 1/02; B43K 1/06

[52] U.S. Cl. ..... 401/292; 401/221; 401/231; 401/235; 401/265

[58] Field of Search ..... 401/221, 261, 401/264, 265, 292, 233, 235, 231; 15/445

[56] References Cited

U.S. PATENT DOCUMENTS

| | | | |
|---|---|---|---|
| 1,621,450 | 3/1927 | Aramian | 401/265 |
| 1,878,879 | 9/1932 | Mon | 401/221 X |
| 2,431,015 | 11/1947 | Andrews et al. | 401/292 |
| 3,518,019 | 6/1970 | Nakamura | 401/265 |
| 3,879,141 | 4/1975 | Shulman | 401/265 |
| 4,531,853 | 7/1985 | Hirabayashi et al. | 401/292 X |
| 4,547,946 | 10/1985 | Osaki et al. | 401/265 X |
| 4,547,947 | 10/1985 | Oshita | 401/265 X |

FOREIGN PATENT DOCUMENTS

| | | | |
|---|---|---|---|
| 1561841 | 4/1970 | Germany | 401/265 |
| 90 | of 1874 | United Kingdom | 401/292 |
| 8748 | of 1892 | United Kingdom | 401/221 |

*Primary Examiner*—Steven A. Bratlie
*Attorney, Agent, or Firm*—Browdy and Neimark

[57] ABSTRACT

A conical penpoint is disclosed which resiliently deflects at its end by the pressure of writing to allow the thickness of written lines to be varied easily. The conical penpoint comprises: a penpoint body having a cylindrical base portion and a conical portion formed of a plurality of comb-tooth pieces continuous to and extending forwardly from the base portion; and an ink supply core installed inside the penpoint body and extending longitudinally therein. The front ends of the comb-tooth pieces are joined together so that the front ends of the adjacent comb-tooth pieces are in resilient contact with each other. When the apex portion formed by the joined front ends of the comb-tooth pieces is pressed against paper with its axis at an angle with respect to the paper, the penpoint elastically deforms allowing the thickness of written lines to be varied.

4 Claims, 9 Drawing Sheets

CONICAL PENPOINT METHOD OF MANUFACTURE

This application is a continuation of application Ser. No. 08/358,399, filed Dec. 19, 1994 now abandoned.

BACKGROUND OF THE INVENTION

1. Field of the Invention

The present invention relates to a conical penpoint or nib used in fountain pens and more particularly to a conical penpoint, which allows writing on paper in any direction, from any position, at any angle, and when it is being rotated about a pen axis, and can perform a variety of modes of calligraphy, including thin and thick characters or lines, and which feels soft when in contact with paper. This invention also relates to a method of manufacturing such a conical penpoint.

2. Prior Art

To eliminate a disadvantage of a common writing instrument with a single penpoint that it can only write in a certain direction, a polygonal penpoint assembly has been proposed, which is formed by combining back to back a plurality (three, for instance) of penpoints similar in structure to the single penpoint to allow writing in any direction. FIG. 25 shows the construction of a conventional penpoint of this kind. In the figure, reference numeral 91 represents a basic penpoint assembly, and 92 denotes a holder that holds the basic penpoint assembly 91.

The basic penpoint assembly 91, as shown in FIG. 26, is made up of three penpoint pieces 910 and has three blades 912 projecting outwardly in three directions, three inwardly curving surfaces 912 between the blades 911, and a semispherical writing tip 922 attached to a front end of the penpoint assembly, with an ink feed path 914 formed at the center. Each of the three penpoint pieces 910 is an inwardly curved metal piece with its pointed end so shaped that it constitutes a part of the writing tip 917. With these penpoint pieces 910 joined together back to back, the assembly as a whole has the form of outwardly projecting blades, with its front end portion forming the semispherical writing tip 914 and with its aligning center for the penpoint pieces 910 forming the ink feed path 915.

The conventional penpoint, as mentioned above, is, formed of three penpoint pieces 910 combined, and the semispherical writing tip 914 at the end allows the penpoint to write on paper in any direction, from any position, at any angle, or even by turning it about the pen axis.

Although the conventional penpoint has the advantage of being able to write from any position, in any direction or when a pen body is turned, however, the tips of the penpoint pieces 910, when applied a pressure, do not move relative to each other. Because the penpoint pieces 910 are joined back to back, the tips of the penpoint pieces 910 tend to move in such a direction as to close a gap, if any, between the tips. Hence, the semispherical body at the end hardly deforms, giving a writer the feel of a hard pen like a ball-pointed pen.

SUMMARY OF THE INVENTION

The present invention has been accomplished with a view to overcoming the above-mentioned drawback. It is therefore a first objective to provide a conical penpoint, which can write on paper at any tilt angle, from any position, from any angle, or when it is turned about the pen axis.

A second objective is to provide a conical penpoint, which, in addition to the above-mentioned basic mode of writing, can perform a variety of modes of calligraphy, including thin and thick lines and characters, and which feels soft when in contact with paper.

A third objective is to provide a method of manufacturing a penpoint, which is simple in structure, reduces the number of manufacturing processes and therefore time and cost, improves accuracy and yield, and is suited for mass production.

To achieve the above objectives, the conical penpoint according to this invention basically comprises: a penpoint body comprising a cylindrical base portion and a hollow conical portion extending forwardly from a longitudinally intermediate part of the penpoint body to a semispherical apex while progressively reducing its diameter; and an ink feed means installed inside the penpoint body and reaching an inner surface of the front end of the conical portion of the penpoint body. The front conical portion of the penpoint body is cut with a plurality of fine slits formed therein at equal intervals extending from the semispherical apex toward the rear, along planes containing an axis of the conical portion, to divide the conical portion into a plurality of comb-tooth pieces. The base-end sides of the comb-tooth pieces merge with the cylindrical base portion, and the comb-to both pieces are joined together at their front ends to form the semispherical apex where the adjacent comb-tooth pieces are in resilient contact with each other.

The semispherical apex of the penpoint body is formed by joining together the front ends of the plurality of the comb-tooth pieces. All the outer edges of the front ends of the comb-tooth pieces making up the semispherical apex are rounded.

With the penpoint of the above construction, when the apex portion, formed by the joined front ends of the comb-tooth pieces, is pressed against paper with a slightly strong force while its axis is at an angle with respect to the paper, the front ends of the comb-tooth pieces move relative to each other to elastically deform the semispherical apex expanding its outer diameter, thus allowing thick lines to be written. When the pressure with which to press the penpoint against the paper is weakened, the front ends of the comb-tooth pieces return to their original relative positions by elasticity to recover the original semispherical shape of the apex portion, thus allowing fine lines to be written.

Hence, with the penpoint of this invention, it is possible to write on paper in any direction, from any position or angle of the semispherical apex of the penpoint because the apex portion is formed of a plurality of the joined front ends of the comb-tooth pieces and because the ink feed paths are formed between the facing sides of the adjoining comb-tooth pieces.

The thickness of written lines can be adjusted by changing the writing pressure. Further, when the pen is used with a large writing force, the comb-tooth pieces as a whole deflect to absorb the force acting as a cushion and giving a soft pen touch so that the writer will not easily get tired after long hours of writing. Moreover, the handwritten characters can be given desired variations in stress or accent. Still another advantage is that if the pen is not used for long hours leaving the ink on the penpoint surface to dry and clog the narrow slits at the front end of the penpoint body, restarting the writing operation causes the semispherical apex to deform moving the gaps and breaking the dry ink film, thereby allowing the liquid ink to easily ooze out.

The conical penpoint fabrication method according to this invention first punches a flat metal plate to form a small metal piece having one end side formed as a strip portion and the other end side formed as comb-tooth pieces. Next, the small metal piece is rolled into a cylindrical shape by bending and rolling using a press and at the same time the individual comb-tooth pieces are combined into a conical shape. Further, the combined front ends of the comb-tooth pieces are rounded into a semispherical shape. Then, the facing edges of the rolled strip portion on the one end side are further welded as necessary to form a cylindrical base portion. As a final step, slit-shaped ink feed paths are formed between facing sides of the comb-tooth pieces on the other end side of the small metal piece, and the combined ends of the comb-tooth pieces form a semispherical writing portion. The metal material used for making the penpoint, once rolled into a cylindrical shape, has a tendency of retaining the cylindrical shape, so that whether the welding should be done or not may be determined depending on the condition of the rolled cylinder.

In this way, because the punching, bending and rounding of the metal plate are all performed by using a press, neither cutting nor grinding work is required. What is required is to round the edges of the punched preliminary formed products and to smooth their surfaces by light polishing Further, the welding need only be done at several points to prevent the cylindrical base portion from being collapsed. Therefore, the fabrication method of this invention eliminates variations in dimensional and positional precisions, allowing mass production with high yield.

BRIEF DESCRIPTION OF THE DRAWINGS

FIG. 5(*b*) is a front-end view showing the same when the apex portion of the penpoint body is in contact with the paper and applied pressure;

FIG. 5(*c*) is a front-end view showing the apex portion of the penpoint body when the conical portion of the penpoint body is formed of six comb-tooth pieces and is directed toward paper in such a way that one of the ink feed paths at boundaries between adjacent comb-tooth pieces assumes the lowest position of the apex portion and when the apex portion is in contact with the paper and applied pressure;

FIG. 6(*b*) is a front-end view showing the same when the apex portion of the penpoint body is in contact with the paper and applied pressure;

FIG. 6(*c*) is a front-end view showing the apex portion of the penpoint body when the conical portion of the penpoint body is formed of five comb-tooth pieces and is directed toward paper in such a way that one of the ink feed paths at boundaries between adjacent comb-tooth pieces assumes the lowest position of the apex portion and when the apex portion is in contact with the paper and applied pressure;

FIG. 25(*b*) is a longitudinal cross section of the same;

FIG. 26(*b*) is a side view of the same; and

FIG. 26(*c*) is a rear-end view of the same.

DESCRIPTION OF THE PREFERRED EMBODIMENTS

Figure 1:
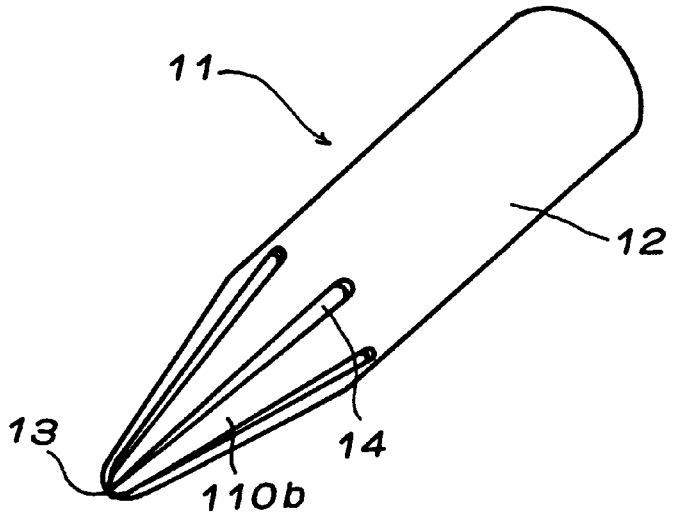
FIG. 1 is a perspective view showing the construction of a conical penpoint as one embodiment of this invention.

FIG. 1 shows a construction of a penpoint as one embodiment of this invention. In FIG. 1, reference numeral 11 represents a penpoint body 11 made from a corrosion-resistant metal such as stainless steel. The penpoint body 11 has a cylindrical base portion 12 at a base end side. From a longitudinally intermediate portion of the penpoint body to the front end, the penpoint body is formed into a hollow cone portion of a progressively reducing diameter. At the pointed end of the hollow cone portion, there is a semispherical apex 13. The hollow cone portion comprises a plurality (generally four to eight; in the embodiment of FIG. 1 six) of comb-tooth pieces 110*b* each tapering off toward the end, and a plurality of narrow slots or gaps formed at equal angles in its peripheral surface and extending from the apex portion 13 toward the rear along planes containing the pen axis to form ink feed paths 14. Each of the comb-tooth pieces 110*b* on the base end side connects integrally with the cylindrical base portion 12.

The front ends of the comb-tooth pieces 110*b* meet together to form the semispherical apex 13, with the adjoining comb-tooth pieces 110*b* in resilient contact with each other. That is, the front end semispherical portion of the penpoint body 11 is formed by combining together the front ends of the comb-tooth pieces 110*b*. The ink feed paths 14 are formed between facing sides of the adjacent comb-tooth pieces 110*b*. Further, it is preferred that all edges on the outer side of the front ends of the comb-tooth pieces 110*b* that form the front end semispherical portion be rounded.

Figure 2:
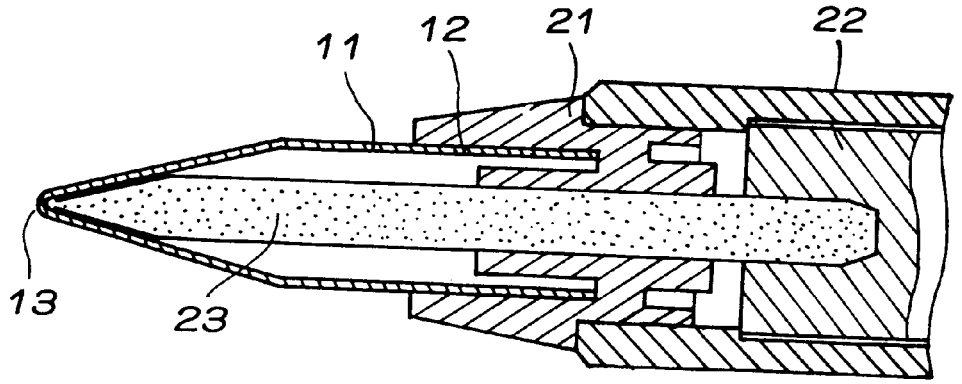
FIG. 2 is a cross section showing the conical penpoint of the first embodiment combined with a neck portion of a pen barrel that holds the conical penpoint.

The penpoint body 11 of this construction is fixed to a neck portion of the pen barrel to form a writing instrument such as a fountain pen. FIG. 2 shows the cross section of a writing instrument using this penpoint body 11. In FIG. 2, reference numeral 21 denotes a barrel neck portion, to which the base portion 12 of the penpoint body 11 is connected. Designated 22 is a cotton type ink tank provided inside the barrel neck portion 21. Denoted 23 is a fibrous core passing through the center of the barrel neck portion 21. The base portion 12 of the penpoint body 11 is pressed into the barrel neck portion 21 so that the fibrous core 23 extending from the cotton type ink tank 22 along the conical inner surface of the penpoint body 11 contacts the inner surface of the apex portion 13. In this construction, ink is supplied from the ink tank 22 through the fibrous core 23 to the inner surface of the apex portion 13, from which the ink flows out onto the outer surface of the apex portion 13 through the ink feed paths 14 that act as capillary tubes.

The operation of a writing instrument using such a conical penpoint is explained. The comb-tooth pieces 110*b* are formed by dividing the conical portion of the penpoint body into a plurality of parts so that their front ends are independent of each other. Each of the comb-tooth pieces 110*b* has its end so shaped as to form one of the divided parts of the semispherical apex 13. The comb-tooth pieces 110*b* on the base end side merge with the cylindrical base portion 12, with the intermediate portion of each comb-tooth piece 110*b* inwardly curved in cross section to form one of the divided parts of a cone. This structure constitutes a triangular cantilever with a boundary with the base portion 12 serving as a fixed end (identical to a cantilever with one end fixed). Hence, during the process of writing using the above-mentioned writing instrument, when an upward force (deflecting force) caused by writing pressure acts on the front end of the comb-tooth pieces 110*b*, the front end of the penpoint, if made from an elastic material such as metal, deflects. When the upward force is removed, the front end of the penpoint restores its original shape.

Figure 3:
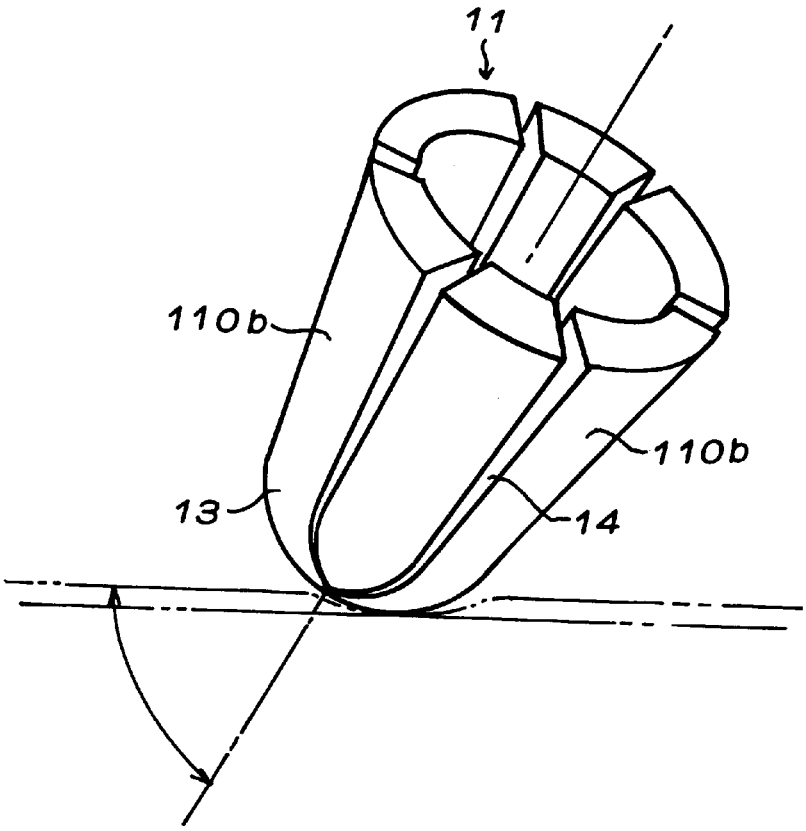
FIG. 3 is perspective view showing an apex portion of a conical penpoint body in contact with paper, the conical penpoint body being formed of six comb-tooth pieces.
Figure 4:
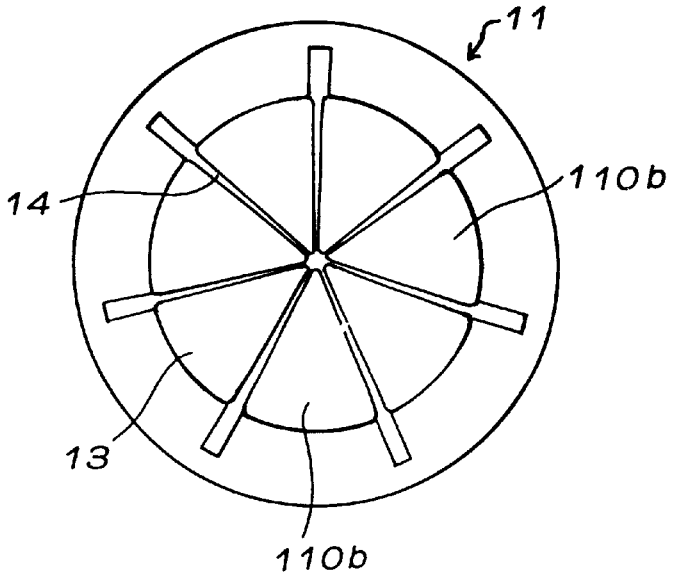
FIG. 4 is a front-end view of the apex portion of the conical penpoint body, which is formed of seven comb-tooth pieces.
Figure 5:
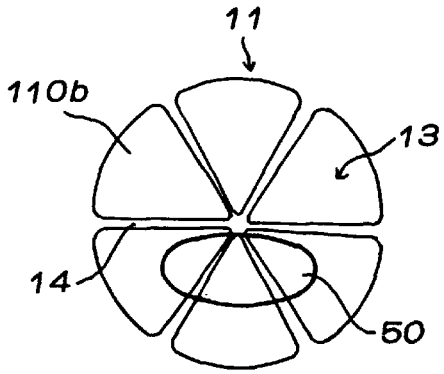
FIG. 5(*a*) is a front-end view showing the apex portion of the penpoint body when the conical portion of the penpoint body is formed of six comb-tooth pieces and is directed toward paper in such a way that one of the comb-tooth pieces assumes the lowest position of the apex portion and when the apex portion is in contact with the paper but not applied pressure.

The semispherical apex 13 formed by joining the front ends of the comb-tooth pieces 110*b* are shown in FIGS. 3, 4, 5(*a*) and 6(*a*). FIG. 3 is a three-dimensional perspective view showing the apex portion 13 of the penpoint body 11 in contact with paper when the conical portion is made up of six comb-tooth pieces 110*b*. FIG. 3 shows how the inwardly curved sides of the comb-tooth pieces 110*b* are disposed about the axis of the conical portion of the penpoint (indicated by the dash-dot line) such that the inwardly-curved arcs of the comb-tooth pieces define a circle perpendicular to the axis line. FIG. 4 is a front-end view of the apex portion 13 of the penpoint body 11 whose conical portion is made up of seven comb-tooth pieces 110*b*. The apex portion 13 of the penpoint body 11 looks like a peeled orange seen from its calyces, whose segments each represent the shape of the front ends of the comb-tooth pieces 110*b*.

Figure 6:
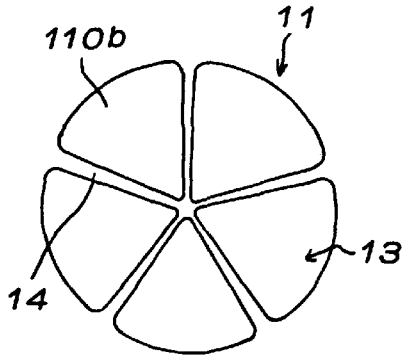
FIG. 6(*a*) is a front-end view showing the apex portion of the penpoint body when the conical portion of the penpoint body is formed of five comb-tooth pieces and is directed toward paper in such a way that one of the comb-tooth pieces assumes the lowest position of the apex portion and when the apex portion is in contact with the paper but not applied pressure.
Figure 5:
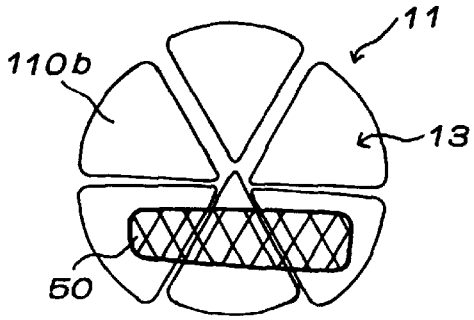
Figure 6:
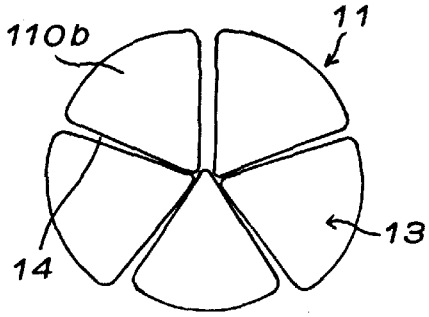
Figure 5:
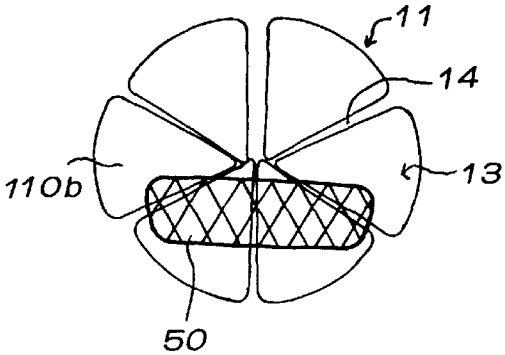
Figure 6:
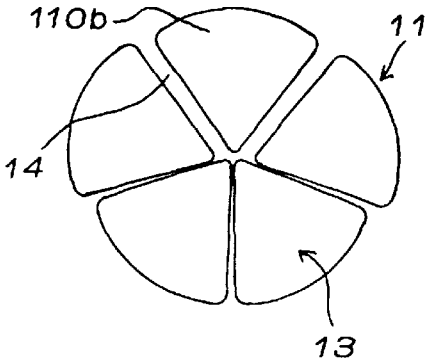

When the penpoint body 11 is placed in contact with paper for handwriting, as shown in FIG. 3, the ink, which has already reached the inside of the front end portion of the ink feed paths 14 or joining gaps in the apex portion 13 of the penpoint body 11 on the side contacting the paper, oozes out by capillary attraction developed in the contact surface between the paper and the apex portion 13 and is transferred onto the paper, forming written lines on it. How the semispherical apex 13 is elastically deformed by the writing pressure during the writing process is shown in FIGS. 5 and 6.

FIG. 5 is front-end views showing how the apex portion 13 of the penpoint body 11, whose conical portion is made up of six comb-tooth pieces 110*b*, is deformed during writing. FIG. 6 is front-end views showing how the apex portion 13 of the penpoint body 11, whose conical portion is made up of five comb-tooth pieces 110*b*, is deformed during writing. Referring to FIG. 5, (a) represents the state of the apex portion 13 when the pen is directed toward paper in such a way that one of the comb-tooth pieces 110*b* assumes the lowest position of the apex portion 13 of the penpoint body 11 and is not yet in contact with paper or, if in contact, is not applied pressure. In this state, because none of the comb-tooth pieces 110*b* are applied a deflecting force, the comb-tooth pieces 110*b* are in resilient contact with each other. Next, as a writer applies force to the pen to write characters, the writing force causes the apex portion 13, a front end of the comb-tooth pieces 110*b* secured to the base portion 12 of the penpoint body 11, to deflect and move upward. At this time, the resistive force of the material of the comb-tooth pieces 110*b* limits the movement or displacement of the front end produced by the normal writing pressure to a specified value, which ranges for example from 0.1 mm to 0.5 mm. At this time, when the semispherical apex 13 is viewed from the front, the front end of the bottom comb-tooth piece 110*b* is pushed up lifting the opposing comb-tooth piece 110*b* and at the same time laterally pushing side the comb-tooth pieces 110*b* on both sides, with the result that the semispherical apex portion 13 is deformed.

As a result, the outer diameter and the area of the semispherical portion contacting the paper increase. In FIG. 5(*b*), a shaded area 50 of the apex portion 13 that contacts the paper increases. The greater the pressure or the writing pressure with which the penpoint is pressed against the paper, the higher the degree of expansion of the contact area. Because the thickness of a written line depends on the outer diameter of the apex portion 13 and increases according to the degree to which the semispherical portion expands, the line is formed thick or thin depending on the magnitude of the writing pressure. This structure also offers an advantage that even when the writing pressure is large, the comb-tooth pieces 110*b* as a whole deflect to absorb a part of the pressure giving a soft pen touch so that the writer will not easily get tired after long hours of writing. Further, it is also possible to give stress or accent variations to the handwritten characters. Furthermore, if the pen is left unused for many hours leaving the ink on the penpoint surface to dry and clog the narrow gaps at the front end of the penpoint body 11, restarting the writing action causes the semispherical apex 13 to deform moving the gaps and breaking the dry ink film, thereby allowing the liquid ink to easily ooze out.

Unlike FIGS. 5(*a*) and 5(*b*), FIG. 5(*c*) shows how the apex portion 13 is deformed when the pen is directed toward the paper in such a way that one of the ink feed paths 14 at boundaries between adjacent comb-tooth pieces 110*b* assumes the lowest position of the front end of the penpoint body 11 and when pressure is applied to the apex portion 13 of the penpoint body 11. In this case, when the semispherical apex 13 is viewed from the front, the writing pressure pushes up the front ends of the bottom two comb-tooth pieces 110*b*, which in turn push aside other comb-tooth pieces 110*b*, thus elastically deforming the semispherical apex 13. Other actions or behaviors are similar to those of FIGS. 5(*a*) and 5(*b*). When the pen is used in ways other than shown in FIGS. 5(*a*), 5(*b*) and 5(*c*), that is, when the pen is rotated about the pen axis through any angle, the apex portion 13 undergoes elastic deformation and slightly expands performing the similar actions or behaviors to those mentioned above as long as the apex portion 13 of the penpoint body 11 is put in contact with paper on the slant.

The apex portion 13 shown in FIG. 6 also undergoes the similar deformations to those mentioned by referring to FIG. 5 during writing. That is, in FIG. 6, (a) represents referring to FIG. 5, (a) represents the state of the apex portion 13 when the pen is directed toward paper in such a way that one of the comb-tooth pieces 110*b* assumes the lowest position of the apex portion 13 of the penpoint body 11 and is not yet in contact with paper or, if in contact, is not pressed against the paper. In this state, because none of the comb-tooth pieces 110*b* is subjected to a deflecting force, the comb-tooth pieces 110*b* are in resilient contact with each other. Next, as a writer applies force to the pen to write characters, the writing force causes the apex portion 13, a front end of the comb-tooth pieces 110*b* secured to the base portion 12 of the penpoint body 11, to deflect and move upward. The displacement of the comb-tooth pieces 110*b* caused by the pressure applied during normal writing is about 0.1 mm to 0.5 mm, as described above by referring to FIG. 5. When the semispherical apex 13, which is made up of five comb-tooth pieces 110*b* in this case, is viewed from the front, it undergoes deformation in the following manner. As shown in FIG. 6(*b*), the front end of the bottom comb-tooth piece 110*b* is pushed up, laterally pushing aside the remaining comb-tooth pieces 110*b* located on both sides.

Unlike FIGS. 6(*a*) and 6(*b*), FIG. 6(*c*) shows how the apex portion 13 is deformed when the pen is directed toward the paper in such a way that one of the ink feed paths 14 at boundaries between adjacent comb-tooth pieces 110*b* assumes the lowest position of the front end of the penpoint body 11 and when pressure is applied to the apex portion 13 of the penpoint body 11. When the semispherical apex 13 is viewed from the front, the writing pressure pushes up the front ends of the bottom two comb-tooth pieces 110*b*, which together push up the opposing top comb-tooth piece 110*b* and laterally push aside the two comb-tooth pieces 110*b* located on both sides. Other actions or behaviors are similar to those described earlier. Although FIG. 6 does not illustrate the shaded area 50 of FIG. 5 where the penpoint contacts the paper, the similar contact area also appears in this case during the writing process.

In the conical penpoint of the above construction, the combined action of the semispherical apex 13, formed at the front end of the joined comb-tooth pieces 110*b*, and the ink feed paths 14 formed between the comb-tooth, pieces 110*b* enables the penpoint to write on paper in any direction, or from any position and angle with respect to the pen axis.

The thickness of written lines can be adjusted by changing the writing pressure. Furthermore, when the pen is used with a large writing force, the comb-tooth pieces 110*b* as a whole deflect to absorb the force acting as a cushion and giving a soft pen touch so that the writer will not easily get tired after long hours of writing. Further, the handwritten characters can be given desired variations in stress or accent. There is another advantage that if the pen is not used for long hours leaving the ink on the penpoint surface to dry and clog the narrow gaps at the front end of the penpoint body 11, restarting the writing operation causes the semispherical apex 13 to deform moving the gaps and breaking the dry ink film, thereby allowing the liquid ink to easily ooze out.

Figure 7:
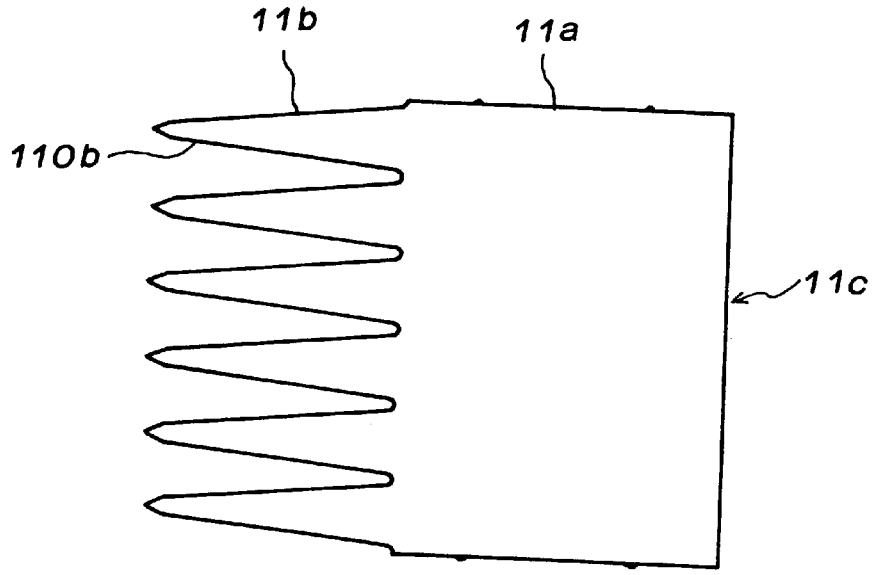
FIG. 7 is a plan view of a pre-worked penpoint material punched out from a flat metal plate by a press in a first method of making the conical penpoint according to this invention.
Figure 8:
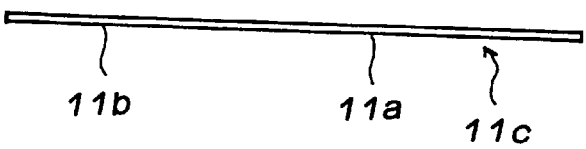
FIG. 8 is a side view of the pre-worked penpoint material of FIG. 7.

Next, one example method of manufacturing the penpoint body 11 is described by referring to FIG. 7 to FIG. 17. This example concerns a case where the penpoint body 11 is fabricated from a metallic plate material such as stainless steel. First, a stainless steel plate is pressed to form a punched plate 11*c*, which consists of a base portion 11*a* in the form of a strip and a front portion 11*b* having a plurality of comb teeth (four to eight teeth; in the example of FIG. 7 six teeth), as shown in FIG. 7. The punched plate 11*c*, immediately after punching, is flat when viewed from the side as shown in FIG. 8.

As is clearly shown in FIG. 7, each of the comb-tooth pieces 110*b* includes at its tip a generally triangluar portion including an apical angle more obtuse than the angle between the two sides of the main portion of the comb-tooth piece.

Figure 9:
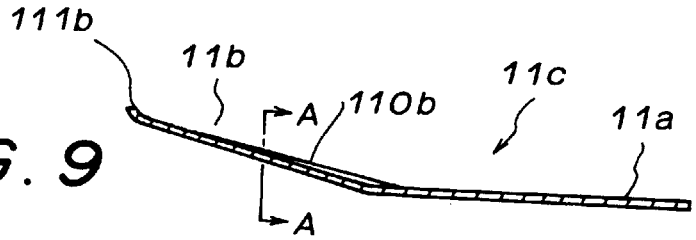
FIG. 9 is a side view of the penpoint material of FIG. 7, whose comb-tooth pieces are inwardly curved in arc, bent at their base and rounded at their front ends all by a press, in the conical penpoint fabrication method of this invention.
Figure 10:
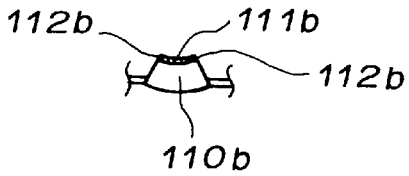
FIG. 10 is a cross section taken along the line A—A of FIG. 9.
Figure 11:
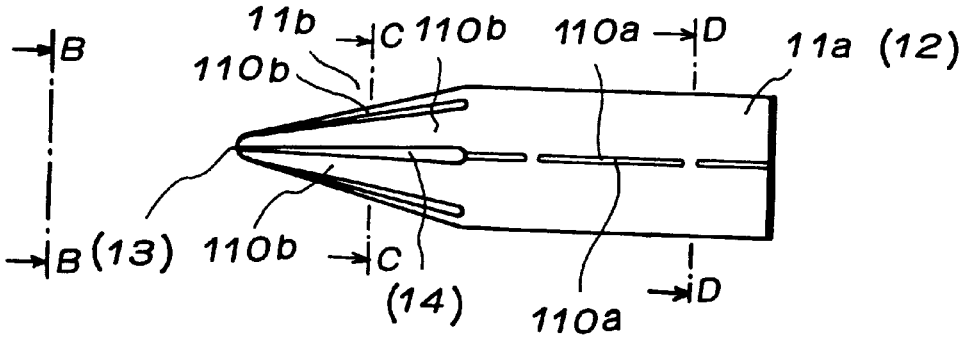
FIG. 11 is a side view of the penpoint material of FIG. 9, which has its one end side rolled by a press and facing edges of the rolled portion welded so that the comb-tooth pieces can be combined into a conical shape.

As shown in FIG. 9, the comb-tooth pieces 110*b* are each bent by the press so that they are inwardly curved in arc with respect to their center lines. At the same time, they are slightly bent at their base and then the punched plate 11*c* thus worked is rolled toward the side to which the comb-tooth pieces 110*b* are bent. The cross section of the comb-tooth piece 110*b* taken along the line A—A of FIG. 9 is shown in FIG. 10.

Before entering the next process, the edges and cut surfaces of the comb-tooth pieces 110*b* of the punched plate 11*c* are polished lightly by sand-blasting or barreling to round the edges 112*b* of the comb-tooth pieces 110*b* and smooth the surface. This work is done to round the edges on both sides of the ink feed paths 14 shown in FIG. 1 into a specified shape. Considering the mass production of the penpoint body 11, it is preferred that this polishing work be performed after the bending of the comb-tooth pieces 110*b* is finished, i.e., before the comb-tooth pieces 110*b* are rolled into a cone in the next step.

Figure 12:
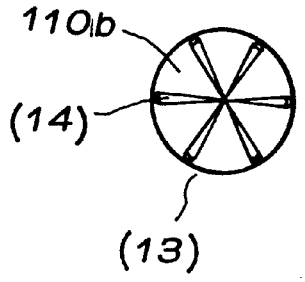
FIG. 12 is a front-end view of the conical portion of the penpoint body as seen from the line B—B of FIG. 11.
Figure 13:
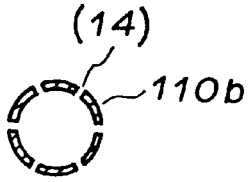
FIG. 13 is a cross section of the conical portion of the penpoint body taken along the line C—C of FIG. 11.
Figure 14:
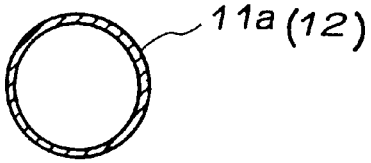
FIG. 14 is a cross section of the base portion of the penpoint body taken along the line D—D of FIG. 11.

Then, as shown in FIG. 11 to FIG. 14, the base portion 11*a* is rolled into a cylinder so that the concave side of the comb-tooth pieces 110*b* faces inwardly, and then the side edges 110*a* are joined. After being formed into a cylinder, the base portion 11*a* may be partly welded at the joined side edges for reinforcement. This welding may or may not be performed because the metal plate used for the manufacture of penpoints, once formed into a cylinder, tends to retain its cylindrical shape. Hence, the welding can be done depending on the condition of the cylindrical structure. With the rolling process performed, the metal strip base portion 11*a* forms the cylindrical base portion 12 of the penpoint body 11 as shown in FIG. 14, and the comb-tooth pieces 110*b* of the front portion 11*b* are combined into a cone, as shown in FIG. 13, at the front end portion of which the adjacent comb-tooth pieces 110*b* are resiliently in contact with each other forming the semispherical apex 13 of the cone. That is, the semispherical end of the cone constitutes the apex portion 13 of the penpoint body 11 and the slits between the adjoining comb-tooth pieces 110*b* form the ink feed paths 14 (see FIG. 12).

Figure 15:
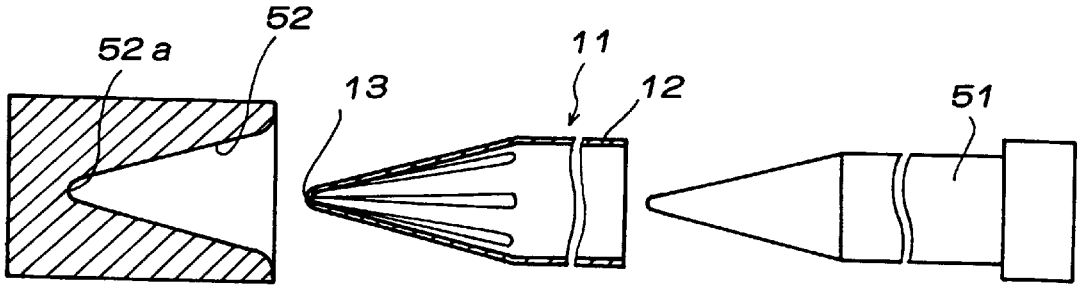
FIG. 15 is a schematic view showing a process adopted in the conical penpoint fabrication method of this invention to reliably form the apex portion of the penpoint body shown in FIG. 11 to 14 into a semispherical shape.
Figure 16:
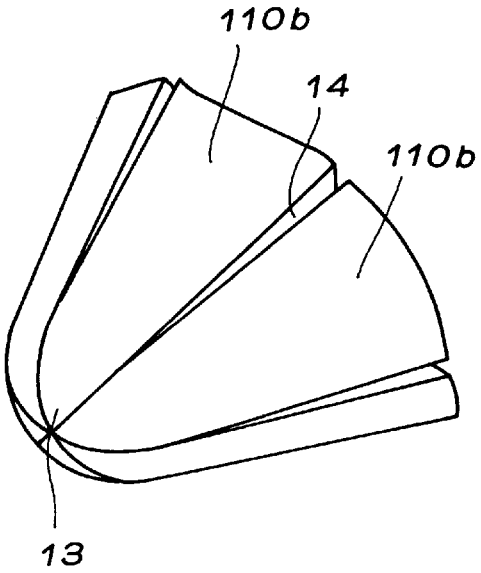
FIG. 16 is an enlarged perspective view of the apex portion of the penpoint body formed by the process shown in FIG. 15.
Figure 17:
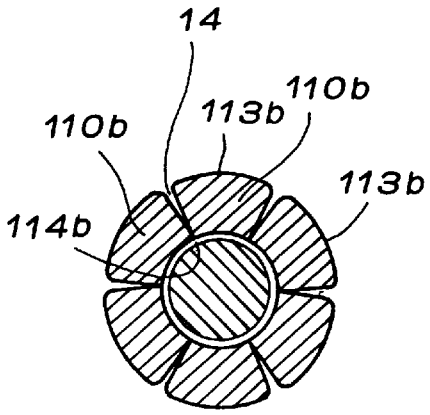
FIG. 17 is a partial cross section of the apex portion of the penpoint body of FIG. 16.

To ensure that the apex portion 13 is formed into a predetermined semispherical shape, a die 51 is inserted into the conical penpoint body 11 from the open end of the base portion 12, as shown in in FIG. 15, and they are fitted in a female die 52 which has the same conical shape as the conical portion of the penpoint body 11 and also the same semispherical shape at its bottom 52*a* as the apex portion 13. Then the rear portion of the die 51 is struck with force to press the die 51 against the inner surfaces of the conical and semispherical portions of the penpoint body 11, thereby shaping the semispherical portion and the conical portion of the penpoint body 12 strictly according to the shapes of the die 51 and the female die 52. As a result, as shown in FIG. 16, the front ends of the comb-tooth pieces 110*b* are, as a whole, formed into a smooth semispherical apex 13, with the adjacent comb-tooth pieces 110*b* in resilient contact with each other. The apex portion 13 has a plurality of comb-tooth pieces 110*b* arranged in circle in cross section, like flower petals, as shown in FIG. 17, and outer circumferential portions 113*b* are pressed against paper for writing. Between the comb-tooth pieces 110*b* are slits which progressively expand from the inner contact portion 114*b* toward the outer circumference and form the ink feed paths 14 to supply ink to the apex portion 13.

The above-mentioned first method of manufacturing the conical penpoint uses a metal plate as the material and performs the steps of punching the metal plate to form a metal strip consisting of a flat base portion 11*a* and a plurality of comb-tooth pieces 110*b* in its front portion 11*b* and then rolling the base portion 11*a* to form the front portion 11*b* into a conical shape. Other materials or manufacturing processes may be used for making the penpoint, as long as the penpoint has a construction such that a conical portion and a semispherical apex at the end of the conical portion are formed by combining a plurality of independent comb-tooth pieces of a certain thickness and that the comb-tooth pieces deflect by the writing pressure and at the same time the apex portion elastically deforms, thereby allowing the thickness of written characters to be varied as desired and giving a writer a feel of soft pen touch.

Figure 18:
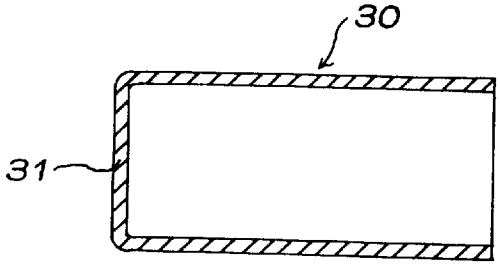
FIG. 18 is a longitudinal cross section of a preliminary formed penpoint, which was deep-drawn from a metal disk, in a second method of making the conical penpoint according to this invention.
Figure 19:
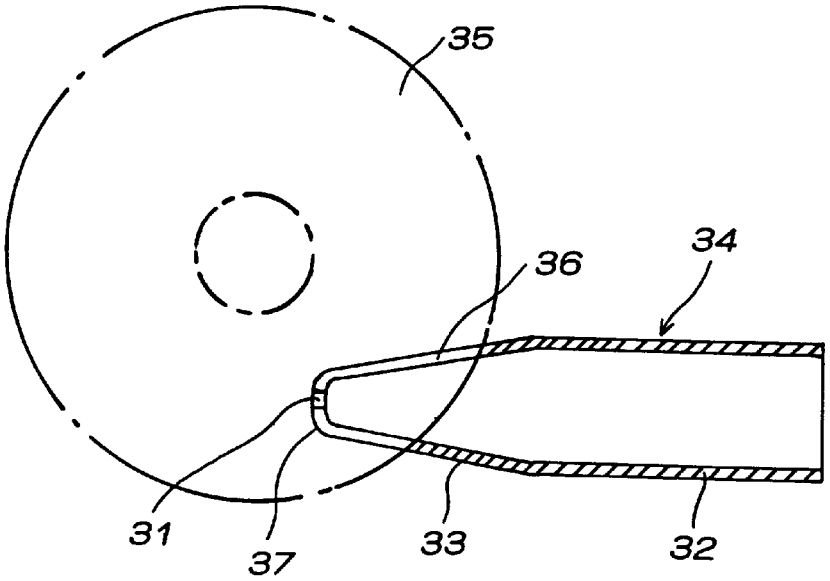
FIG. 19 is a schematic view of the deep-drawn, preliminary formed penpoint, showing the process of cutting the preliminary formed penpoint in the second method of making the conical penpoint.
Figure 20:
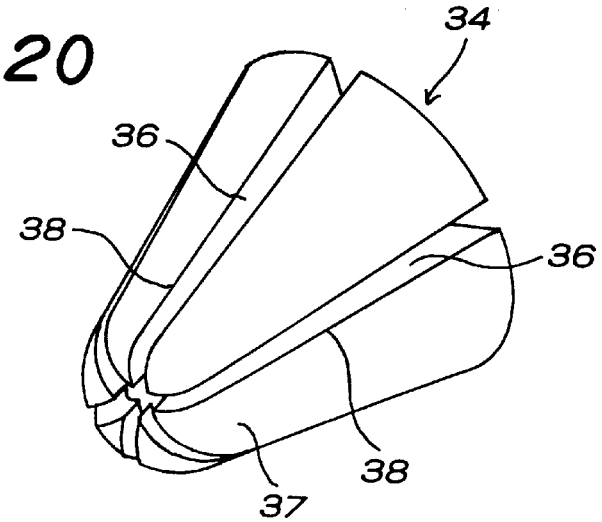
FIG. 20 is an enlarged perspective view of the apex portion of the preliminary formed penpoint cut with slits in the second method of making the conical penpoint.

FIG. 18 through FIG. 21 show a second method of making the penpoint body 11. This method, as shown in FIG. 18, first punches out a metal disk of such material as stainless steel and deep-draws it to form a cylindrical body 30 with a small hall 31 at the bottom. The cylindrical body 30 is subjected to further deep-drawing to make a preliminary formed penpoint body 34, which, as shown in FIG. 19, has a cylindrical base portion 32 on the base-end side and a conical portion 33 on the front-end side, which is continuous to the base portion 32. Further, the front end portion of the preliminary formed penpoint body 34 is pressed or ground to be rounded and formed into a semispherical portion 37. After this, by using a groove-cutting grinder disk 35, the conical portion 33 is cut with a plurality of slits 36 spaced at equal angles in a circumferential direction of the conical portion 33 and which run on planes containing the axis of the penpoint body. As a result, a plurality of comb-tooth pieces 110*b* are formed. FIG. 20 shows the perspective view of the front end portion of the preliminary formed penpoint body 34 cut with the slits 36.

Instead of the foregoing process, it is possible to swage the front-end side of a metal pipe into a conical shape and round the front end portion to form the semispherical portion 37, thereby making the preliminary formed penpoint body shown in FIG. 19. In this case also, the cutting of the slits 36 is performed in the same way as described above.

Figure 21:
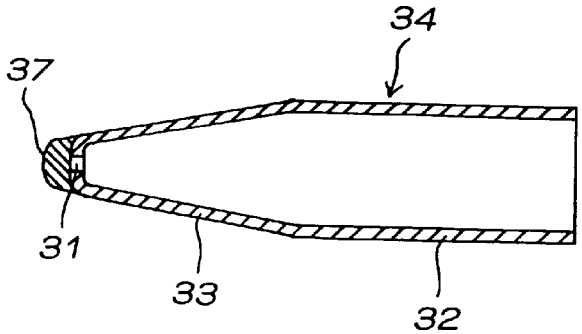
FIG. 21 is a schematic view of the deep-drawn, preliminary formed penpoint welded with an iridium apex portion in the second method of making the conical penpoint.

FIG. 21 is a cross section of the preliminary formed penpoint body 34. This cross section shows the process of forming the semispherical portion 37, which involves the steps of welding a small ball of iridium alloy to the front end portion of the preliminary formed penpoint body 34 and then rounding it by grinding to form the semispherical portion 37. This process is performed prior to cutting the slits 36 in the conical portion 33, which was fabricated either by subjecting the preliminary formed penpoint body 34 to deep drawing shown in FIG. 18 to 20 or to swaging. After the semispherical portion 37 of iridium alloy is formed, the conical portion 33 is cut by the grinder disk. In this way, the front end portion of the preliminary formed penpoint body 34 with cut slits 36 as shown in FIG. 20 can be obtained. Any appropriate technique may be applied for welding the iridium alloy.

After the preliminary formed penpoint body 34 is cut with the slits 36 in its front end portion, it is subjected to sand-blasting, barreling or buffing to polish the surfaces of, and to round the edges of, the cut slits 36 and the semispherical portion 37. Next, the base of the comb-tooth pieces 110*b* of the conical portion 33, i.e., the boundary portion with the cylindrical base portion 32, is pressed or bent. This forces the comb-tooth pieces 110*b* toward each other, closing the gaps of the cut slits 36, so that the comb-tooth pieces 110*b* are in elastic contact with the adjacent ones, forming the semispherical apex 13 at their front ends. The slits between the adjoining comb-tooth pieces 110*b* serve as the ink feed, paths 14.

Figure 23:
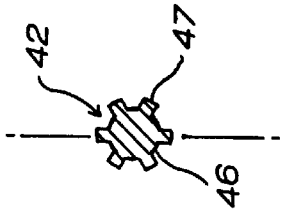
FIG. 23 is a cross section of a conical portion of the core pin of FIG. 22, taken along the line of E—E of FIG. 22.
Figure 24:
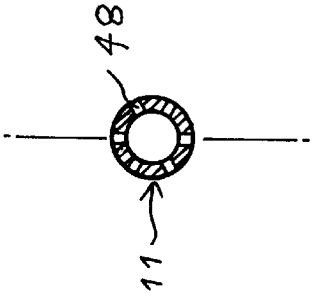
FIG. 24 is a cross section of the conical portion of the penpoint body of FIG. 22, taken along the line of F—F of FIG. 22.
Figure 22:
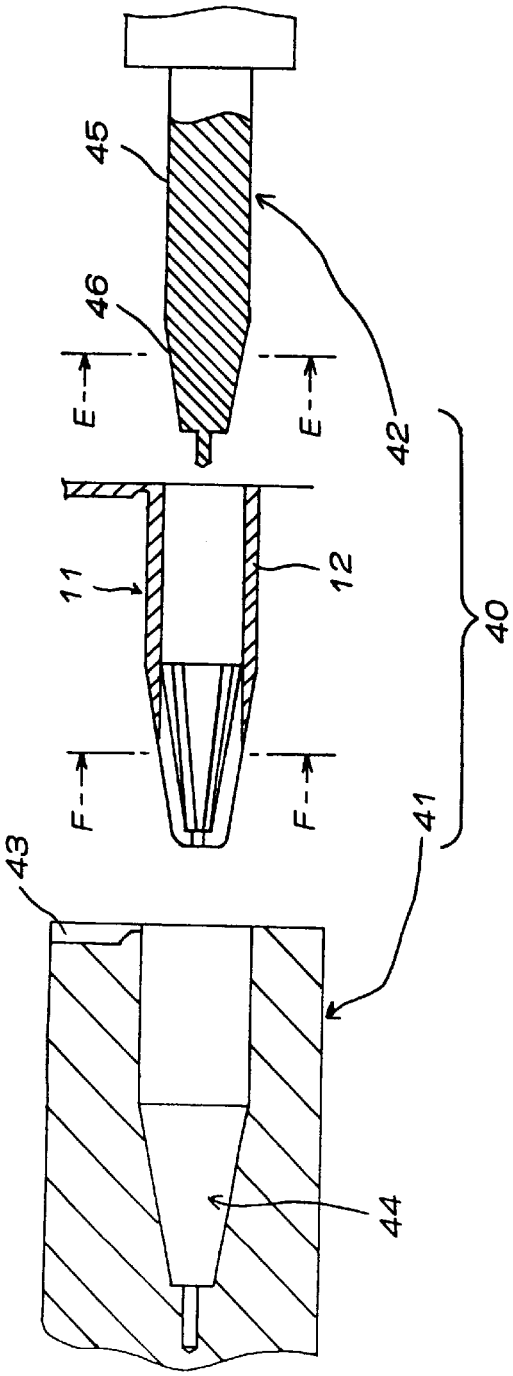
FIG. 22 is a schematic view showing a process of forming the penpoint body by injection molding using synthetic resin material in the second method of making the conical penpoint.
Figure 25:
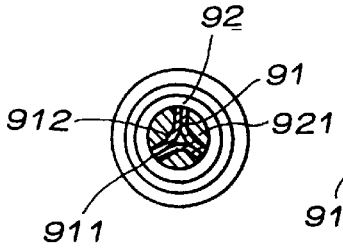
FIG. 25 (a) PRIOR ART
FIG. 25(*a*) is a front-end cross-sectional view showing the construction of a conventional penpoint.
Figure 25:
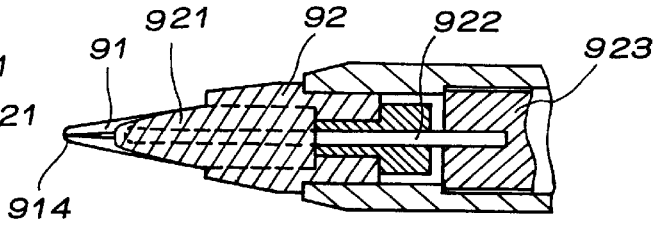
FIG. 25 (b) PRIOR ART
Figure 26:
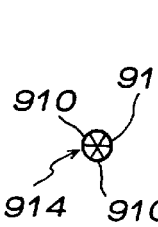
FIG. 26 (a) PRIOR ART
FIG. 26(*a*) is a front-end view of the front end of a basic penpoint body used in the conventional penpoint.
Figure 26:
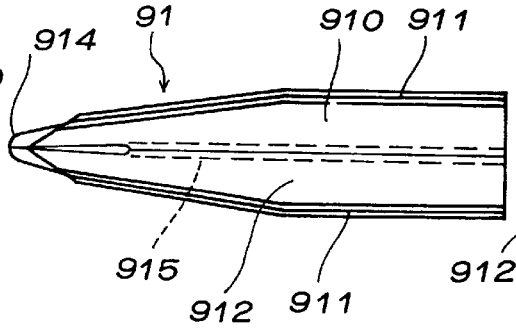
FIG. 26 (b) PRIOR ART
Figure 26:
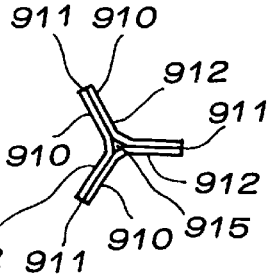
FIG. 26 (c) PRIOR ART

FIG. 22 to 24 show a third method of manufacturing the penpoint body 11. Unlike the previous two methods, this method injection-molds a synthetic resin material to form the penpoint body 11. Referring to FIG. 22, reference numeral 41 represents a female mold and 42 a core pin male mold installed inside the female mold 41. This female mold 41 and the core pin 42 together constitute a mold 40. The female mold 41 is provided with a resin supply port 43 through which to supply molten synthetic resin material from outside the mold 40 and with a cavity 44, a chamber into which the synthetic resin material is injected. The core pin 42 consists of a cylindrical base portion 45 and a conical portion 46 at the front of the base portion 45, their shapes corresponding to that of the penpoint body 11 to be manufactured. The core pin 42 also has a plurality of fin-like protrusions 47 on the surface of the conical portion 46 that extend radially along the axis of the conical portion 46. The provision of the fin-like protrusions 47 forms slits 46 in the product during injection molding. On both sides of the slits 48 are formed comb-tooth pieces 110*b*. In this way, the front end portion of the preliminary formed penpoint body 34 similar to that shown in FIG. 20 is obtained.

FIG. 22 shows an injection-molded penpoint body 11 taken out from a cavity 44 of a mold 40 with a core pin 42 pulled out of the preliminary formed penpoint body 34. After the preliminary formed penpoint body 34 is made, it is subjected to sand-blasting, barreling or buffing to polish the surfaces of, and round the edges 38 of, the slits 48 and the semispherical portion 37 of the preliminary formed penpoint body 34, as in the case of the second manufacturing method. Next, the base portion of the comb-tooth pieces 110*b* of the conical portion 33, i.e., the boundary portion with the cylindrical base portion 32, is pressed or bent. This forces the comb-tooth pieces 110*b* toward each other, closing the gaps of the cut slits 36, so that the comb-tooth pieces 110*b* are in elastic contact with the adjacent ones, forming the semispherical apex 13 at their front ends. The slits between the adjoining comb-tooth pieces 110*b* serve as the ink feed paths 14 (FIG. 12). The injection molding allows a greater number of products to be formed than when a metal material is worked, so it makes for more efficient mass production. Another advantage of injection molding is a smaller number of manufacturing processes. With the injection molding, therefore, it is possible to manufacture a large number of products at less cost.

The third method of manufacturing the penpoint body 11 does not require a number of processes, such as cutting, grinding and polishing, except for light polishing such as blasting and barreling performed to round edges and smooth surfaces of the molded product. This reduces variations in dimensional and positional accuracies, which may be caused by machining processes, allowing mass production of the penpoint body 11 with high yield and less cost.

What is claimed is:

1. A method of manufacturing a conical penpoint comprising the steps of:

punching a flat metal plate by a press to form a small metal piece having one end side formed as a flat strip portion and the other end side formed as comb-tooth pieces (110*b*);

pressing said comb-tooth pieces of the small metal piece so that they are bent to be inwardly curved in arc with respect to center lines thereof;

further bending said comb-tooth pieces at bases thereof so that front ends of the comb-tooth pieces are positioned slightly separated upward from base faces, and that inwardly curved sides of said comb-tooth pieces are positioned inside;

rolling the front ends of the comb-tooth pieces toward the side to which the comb-tooth pieces are bent under such a condition that the flat strip portion remains flat;

rolling the small metal piece into a cylindrical shape by bending and rolling using a press such that the inwardly curved sides of said comb-tooth pieces are facing inside, and then joining facing edges of a resulting rolled strip portion;

combining the individual comb-tooth pieces into a conical shape; and rounding the combined front ends of the comb-tooth pieces into a semispherical shape;

wherein the rolled strip on one end side of the small metal pieces forms a cylindrical base portion, slit-like ink feed paths are formed between facing sides of the comb-tooth pieces on the other end side of the small metal piece, and the combined ends of the comb-tooth pieces form a semispherical writing portion.

2. A method of manufacturing a conical penpoint according to claim 1, wherein after bending and rolling the small metal piece into a cylindrical shape and joining the facing edges of the rolled strip portion on the one end side of the small metal piece, the joined facing edges are further welded depending on the condition of the joint.

3. The method according to claim 1, wherein the step of punching includes punching each of the comb-tooth pieces (110*b*) to include at a respective tip thereof an apical angle more obtuse than an angle between two sides of a main portion of the comb-tooth piece.

4. A method of manufacturing a conical penpoint comprising the steps of sequentially:

punching a flat metal plate by a press to form a small metal piece having a rear end formed as a flat strip portion and a front end side formed as comb-tooth pieces (110*b*), and including an inner side and an outer side;

pressing said comb-tooth pieces of the small metal piece so that they are bent toward the inner side and are inwardly curved in arc with respect to center lines thereof;

further bending said comb-tooth pieces at bases thereof toward the inner side so that front ends of the comb-tooth pieces are moved from a plane of the flat strip portion;

while the flat strip portion remains flat, rolling the front ends of the comb-tooth pieces toward the inner side, whereby rounding of the combined front ends of the comb-tooth pieces into a semispherical shape will occur during rolling;

polishing the inner side;

rolling the flat strip portion into a cylindrical shape such that the inwardly curved sides of said comb-tooth pieces are mutually facing;

joining facing edges of a resulting rolled strip portion;

combining the individual comb-tooth pieces into a conical shape;

wherein the rolled strip on one end side of the small metal pieces forms a cylindrical base portion, slit-like ink feed paths are formed between facing sides of the comb-tooth pieces on the other end side of the small metal piece, and the combined ends of the comb-tooth pieces form a semispherical writing portion.

* * * * *